US010451373B2

(12) United States Patent
Wolf

(10) Patent No.: US 10,451,373 B2
(45) Date of Patent: Oct. 22, 2019

(54) FIREARM BARREL

(71) Applicant: ZEV Technologies, Inc., Oxnard, CA (US)

(72) Inventor: Alec Daniel Wolf, Newbury Park, CA (US)

(73) Assignee: ZEV Technologies, Inc., Oxnard, CA (US)

( * ) Notice: Subject to any disclaimer, the term of this patent is extended or adjusted under 35 U.S.C. 154(b) by 0 days.

(21) Appl. No.: 15/001,071

(22) Filed: Jan. 19, 2016

(65) Prior Publication Data

US 2016/0209147 A1 Jul. 21, 2016

Related U.S. Application Data

(63) Continuation-in-part of application No. 14/997,425, filed on Jan. 15, 2016, now abandoned.

(60) Provisional application No. 62/104,607, filed on Jan. 16, 2015.

(51) Int. Cl.

| | |
|---|---|
| ***F41A 21/02*** | (2006.01) |
| ***F41A 21/24*** | (2006.01) |
| ***F41C 3/00*** | (2006.01) |

(52) U.S. Cl.

CPC ..... *F41A 21/24* (2013.01); *F41C 3/00* (2013.01)

(58) Field of Classification Search

CPC ..... F41A 21/20; F41A 21/18; F41A 21/22; F41A 21/00; F41A 21/24

USPC ..... 89/14.05, 14.1, 16, 14.7, 159, 160, 161, 89/162; 42/76.01, 76.02, 77, 78, 76.1

See application file for complete search history.

(56) References Cited

U.S. PATENT DOCUMENTS

| | | | | | |
|---|---|---|---|---|---|
| 855,439 | A | | 6/1907 | Adrianson | |
| 2,351,037 | A | * | 6/1944 | Green | F41A 21/34 89/14.5 |
| 2,361,932 | A | * | 11/1944 | Fay | F41A 21/24 89/14.1 |
| 2,375,721 | A | | 5/1945 | Woodhull | |
| 4,527,348 | A | | 7/1985 | Brennan | |
| D283,040 | S | * | 3/1986 | Holland | D22/104 |
| 5,140,893 | A | * | 8/1992 | Leiter | F41A 21/26 89/14.5 |
| 5,415,073 | A | * | 5/1995 | Ciluffo | F41A 21/36 89/14.2 |
| 5,435,089 | A | * | 7/1995 | Rodney, Jr. | F41C 9/08 42/51 |
| 5,577,555 | A | * | 11/1996 | Hisajima | F25B 15/06 165/109.1 |

(Continued)

FOREIGN PATENT DOCUMENTS

| | | | | |
|---|---|---|---|---|
| DE | 19523644 A1 | * | 1/1997 | F41A 21/24 |

OTHER PUBLICATIONS http://www.thefirearmblog.com/blog/2014/11/19/robinson-model-11-machine-pistol-1940s-pdw/ TFB The Firearm Blog Nov. 19, 2014.*

(Continued)

*Primary Examiner* — Benjamin P Lee

(74) *Attorney, Agent, or Firm* — Knobbe Martens Olson & Bear LLP

(57) ABSTRACT

A semiautomatic pistol having a barrel with an exterior surface that has a plurality of indentations and dimples to dissipate heat and reduce frictional engagement between the barrel and the slide. The barrel component includes a crown portion that is recessed to protect the crown portion by a pocket.

20 Claims, 6 Drawing Sheets

(56) References Cited

U.S. PATENT DOCUMENTS

| | | | | |
|---|---|---|---|---|
| 6,324,780 | B1 * | 12/2001 | Behling | F41A 21/18 42/78 |
| 7,013,592 | B2 * | 3/2006 | Olson | F41B 11/00 42/76.01 |
| 8,025,003 | B1 * | 9/2011 | Saur | F41A 21/24 42/76.01 |
| 9,103,618 | B2 | 8/2015 | Daniel | |
| 9,261,317 | B2 | 2/2016 | Daniel | |
| D767,071 | S | 9/2016 | Wolf | |
| 2005/0115398 | A1 * | 6/2005 | Olson | F41A 21/00 89/193 |
| 2005/0229464 | A1 * | 10/2005 | Olson | F41B 11/00 42/76.02 |
| 2010/0275491 | A1 * | 11/2010 | Leiter | F41A 33/02 42/76.01 |
| 2011/0094138 | A1 * | 4/2011 | Dubois | F41A 3/74 42/59 |
| 2013/0340313 | A1 * | 12/2013 | Myers | F41A 21/30 42/90 |
| 2015/0043700 | A1 | 2/2015 | Rosso | |
| 2016/0016217 | A1 * | 1/2016 | Engesser | B21C 37/152 42/76.1 |
| 2016/0209145 | A1 | 7/2016 | Wolf | |

OTHER PUBLICATIONS http://www.thefirearmblog.com/blog/2014/11/17/chinese-qx-04-rifling-delayed-blowback-pistol/ TFB The Firearm Blog Nov. 17, 2014.*

Shooter Ready website page "Grand Power X-Calibur Review", dated Feb. 4, 2014 (blog review) pp. 1-9.*

Benchrest Central forum webpage http://benchrest.com/showthread.php?75671-Barrel-Crown/page4, date: 8/10/20011, pp. 3 and 4.

Bolke, "Building the 'Do It All' Carbine Part II", Panteao Productions, http://modernserviceweapons.com/?p=3582, in 4 pages, Jun. 19, 2013.

Snipers Hide forum webpage http://forum.snipershide.info/showthread.php?t=17003, p. 8 of 10 picture dated May 6, 2009 (posted).

* cited by examiner

FIREARM BARREL

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

The present invention relates to barrels for firearms and, in particular, concerns a barrel for a firearm such as a semiautomatic pistol that has a dimpled surface for heat dissipation and reduced friction and an improved recessed barrel exit for accuracy.

Description of the Related Art

Firearms typically include a plurality of components including a barrel through which a slug travels a receiver that houses the unfired cartridge and the firing pin assembly that fires the cartridge, a trigger assembly that engages with the firing pin assembly, a magazine which can hold multiple cartridges and a grip assembly that permits the shooter to hold the firearm. One common type of firearm is a semi-automatic pistol such as the pistols sold by Glock, Smith and Wesson etc.

Many of these types of pistols typically have a slide assembly that houses the barrel and the barrel is pivotable with respect to the receiver so that the barrel can be moved during the recoil of the firearm to facilitate reloading of the firing chamber during semi-automatic operation. This occurs when the slide assembly retracts backward after the weapon has been fired to then cycle forward to reload the firing chamber for subsequent firing.

Barrels can in some instances become heated during multiple firing which can result in the barrel becoming deformed and less accurate. A further issue that occurs with semiautomatic firearms is that the barrel can frictionally engage with the slide which can hinder proper operation of the slide.

Yet another issue that occurs with these types of firearms is that the barrel of a pistol is relatively short and the interface between the end of the interior chamber of the barrel and the outside environment can be relatively disruptive. As the firearm is fired, high pressure hot gasses are propelling the bullet or slug down the barrel. At the end of the barrel, the gasses hit the outside environment which can result in turbulence that can affect future flight performance and accuracy of the bullet in its ballistic trajectory.

From the foregoing, there is a need for a barrel assembly that has reduced resistance to heating and friction and provides a better exit of the barrel to facility accuracy of the bullet.

SUMMARY OF THE INVENTION

The aforementioned needs are satisfied by the barrel for a semiautomatic hand gun and a handgun incorporating the same. In one implementation, the outer surface of the barrel is covered by a plurality of indentations or dimples that are arranged in offsetting columns or rows extending down the length of the barrel. The dimples can be of varying depths but in some non-limiting embodiments, the depths are 0.015 inches and the diameters are in these non-limiting examples 0.375 inches with the center of the dimples being in these examples 0.250 inches apart. It will be appreciated that variations to these dimensions can be made by those skilled in the art without departing from the sprit or scope of the present invention.

The aforementioned needs are also satisfied by the barrel crown which features an initial crown comprising a cylindrical ring comprising the crown that is angled outward and begins adjacent the end of the rifling of the barrel. A circular pocket is then formed so as to have a wider diameter than the cylindrical ring which further recesses the cylindrical ring. The cylindrical ring is preferably angled so as to provide a smooth gas flow path of the gasses to reduce turbulence at the barrel end atmosphere interface. In one non-limiting example, the cylindrical ring is angled at approximately 45 degree angle and has a depth of approximately 0.027 inches. However, a person of ordinary sill in the art will appreciate that these dimensions can vary without departing from the spirit and scope of the present invention. In one implementation the outer diameter of the ring or crown is approximately 0.400 inches and the outer diameter of the cylindrical pocket is 0.471 inches. The pocket provides protection for the interior surfaces of the crown and cylindrical ring by recessing these surfaces into the barrel thereby lessening the risk of these surfaces being scratched or otherwise damaged. In one non-limiting implementation, the pocket has a depth of 0-1018 inches but it will be appreciated that various changes and substitutions into the dimension can be made by those skilled in the art without departing from the present teachings.

DETAILED DESCRIPTION OF THE PREFERRED EMBODIMENT

Figure 1:
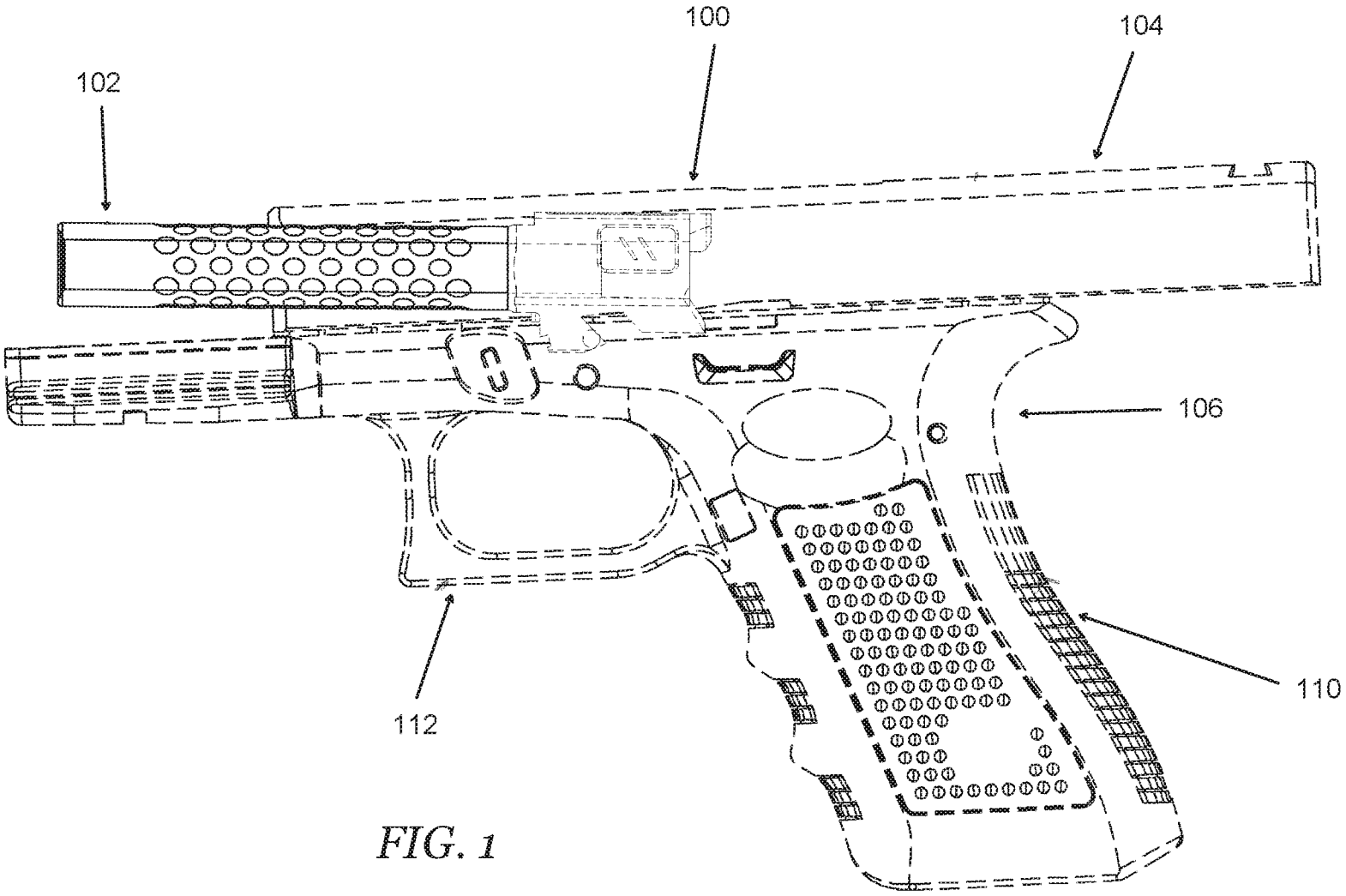
FIGS. 1-3 are side top and bottom views of a firearm having a barrel component that is dimpled and has an improved crown.
Figure 2:
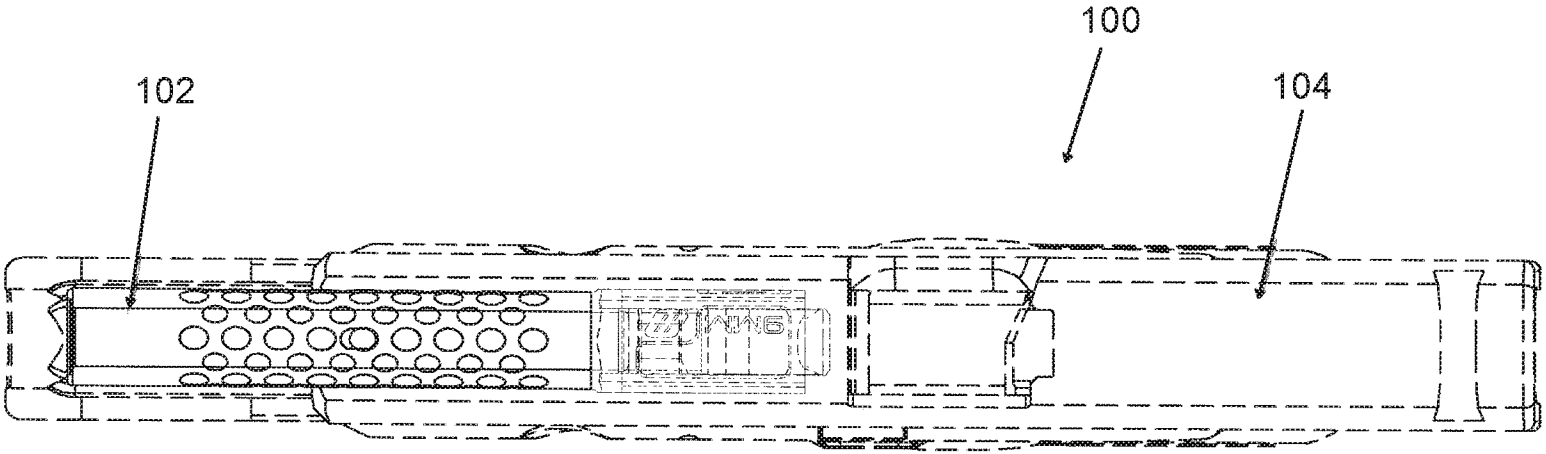
Figure 3:
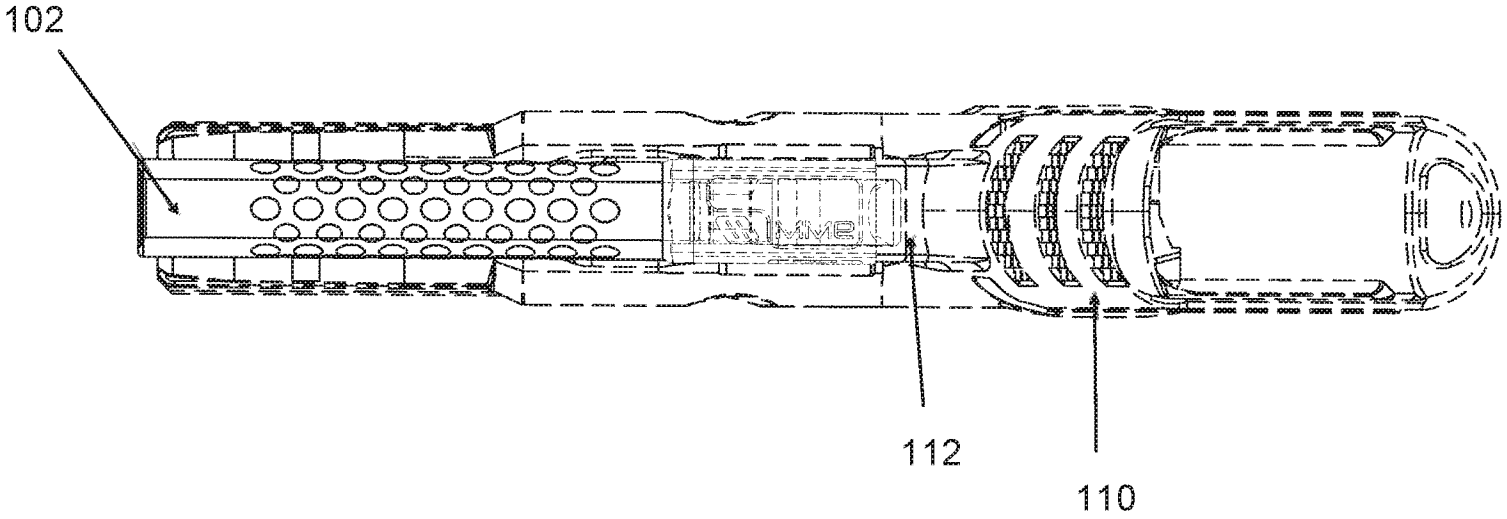

Reference will now be made to the drawings wherein like numerals refer to like parts throughout. FIGS. 1-3 illustrates an exemplary firearm 100 that includes a barrel component 102 that is positioned within a slide 104. The slide houses a receiver that includes a firing pin assembly and is attached to one end of the barrel component 102. The slide 104 is mounted to a frame 106 that includes a grip 110 and a trigger assembly 112. The operation of the firearm 100 is similar to the operation of any semiautomatic pistol; the trigger assembly is pulled to cause the firing pin to fire the cartridge which is then propelled down the barrel by compressed gasses. The force of firearm causes the slide to retract to cock the firing pin and also induces the barrel component to rotate to receive a new cartridge in a known manner.

FIGS. 4A-4D illustrate the barrel in greater detail. The barrel component 102 includes a firing chamber 114 that receive the cartridge to be fired and also includes a pivot assembly 116 that engages with the frame of the firearm 100 to pivot in the above described manner. The barrel component also includes a rifled barrel 120 that defines an interior path 122 that is in this non-limiting embodiment rifled with rifling 124. The rifling 124 preferably extends from a position adjacent the firing chamber 114 to a position adjacent an end 126 of the barrel 120 that includes a crown portion 130 that will be described in greater detail hereinbelow.

As shown, the barrel 120 includes an outer cylindrical surface 132 that has a plurality of indentations or dimples 134 that are formed therein. In one embodiment, the dimples are equally spaced apart at a distance of "C" and in varying depths of "A" per row. The dimples 134 are formed in one exemplary embodiment by a rotary cutting tool dictated by its ball end shape feature the diameter "B" but the present teachings are not limited to this method of formation. As shown, the dimples 134 are arranged in offset rows to increase the number of dimples on the outer surface 132 of the barrel component 102.

Advantageously, the outer surface 132 of the barrel 120 includes regions 140*a* and 140*b* that are not dimpled. The undimpled region 140*a* is located adjacent the firing chamber 114 and the undimpled region 140*b* is located adjacent the end 126 of the barrel 120. In one implementation, the undimpled region 140*b* located adjacent the end 126 of the barrel is sized so as to have a length such that a substantially unbroken surface engages with the slide 104 so that there is a continuous connection between the barrel and the slide at the beginning of the firing cycle which results the firearm being more stable during the shooting cycle. In one specific implementation, the region 140*b* is approximately ½ to ¾ of an inch long but this length can vary depending upon the implementation.

FIGS. 5A-5D illustrate some of the dimensions associated with one example of the dimples 134 and the crown portion 130 that will be described below. As shown, in these implementations, the dimples are formed with a rotary cutter having a diameter of 0.375 inches, a depths of 0.015 inches and are spaced so that there centers are 0.250 inches apart. In one implementation, the barrel 120 has an approximate length of 4.00 to 5.00 inches but this can vary depending upon the implementation.

The dimpled surface in the context of a semiautomatic pistol has at least two advantages. One advantage is that the dimples creates a greater surface area of the rifled barrel part 120 of the barrel component 102 which increases the amount of area that can dissipate heat. As is understood, the firing of cartridges causes the barrel to heat which is dissipated through the outer surface 132 of the barrel. Increasing this outer surface area improves heat dissipation.

A further advantage occurs in the context of semiautomatic pistols that operate in the manner described above. By dimpling the surface, the amount of surface area of the outer surface 132 of the barrel part 120 of the barrel component 102 that is slidably engaged with the slide 104 is reduced. This results in a reduction in the frictional engagement between the slide 104 and the barrel component 102 which results in smoother operation of the firearm 100 due to the reduced surface area contact.

Figures 5A, 5B, 5C, 5D:
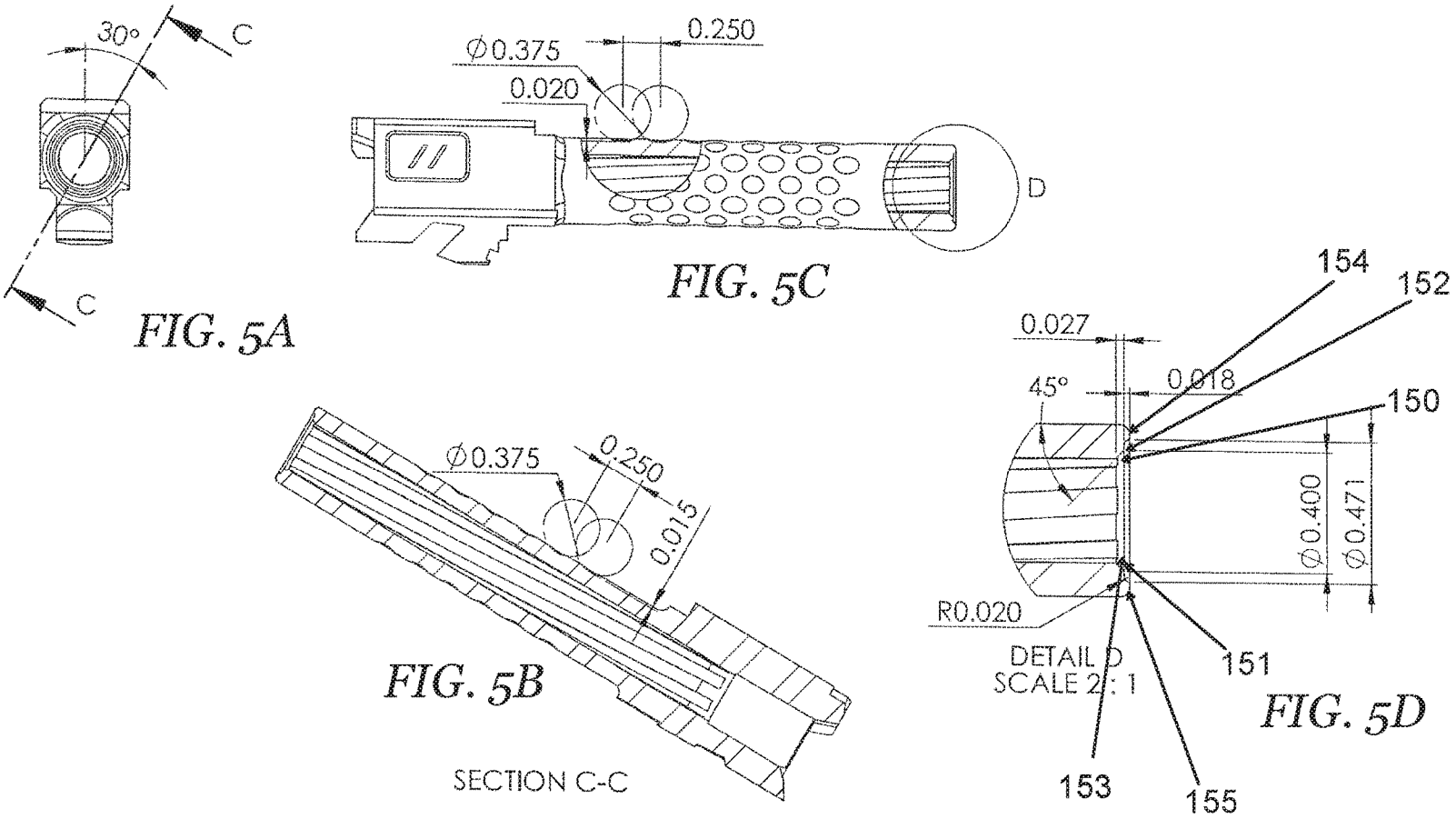
FIGS. 5A-D are front, side, cross sectional and detailed cross sectional views of the barrel component of FIGS. 1-3.

A further feature of the barrel component is the crown portion 130. The crown portion 130 is located adjacent the outer end 126 of the barrel and is interposed between the riflings 124 and the end 126 of the barrel 120. As shown in FIG. 5D, the crown portion 130 includes an angled portion 150 that angles outward from the rifling 124 and then a flat portion 152 followed by a straight portion 154.

The angled portion 150 defines an angled surface 151 that has an angle, in one embodiment of approximately 45 degrees and extends circumferentially about the interior path 122 of the barrel 120. The angled portion 150 provides a pathway for gasses to be vented outward from the interior path of the barrel at the barrel atmosphere interface which reduces turbulence on the slug or bullet as it exits the barrel 120.

Figures 4A, 4B, 4C:
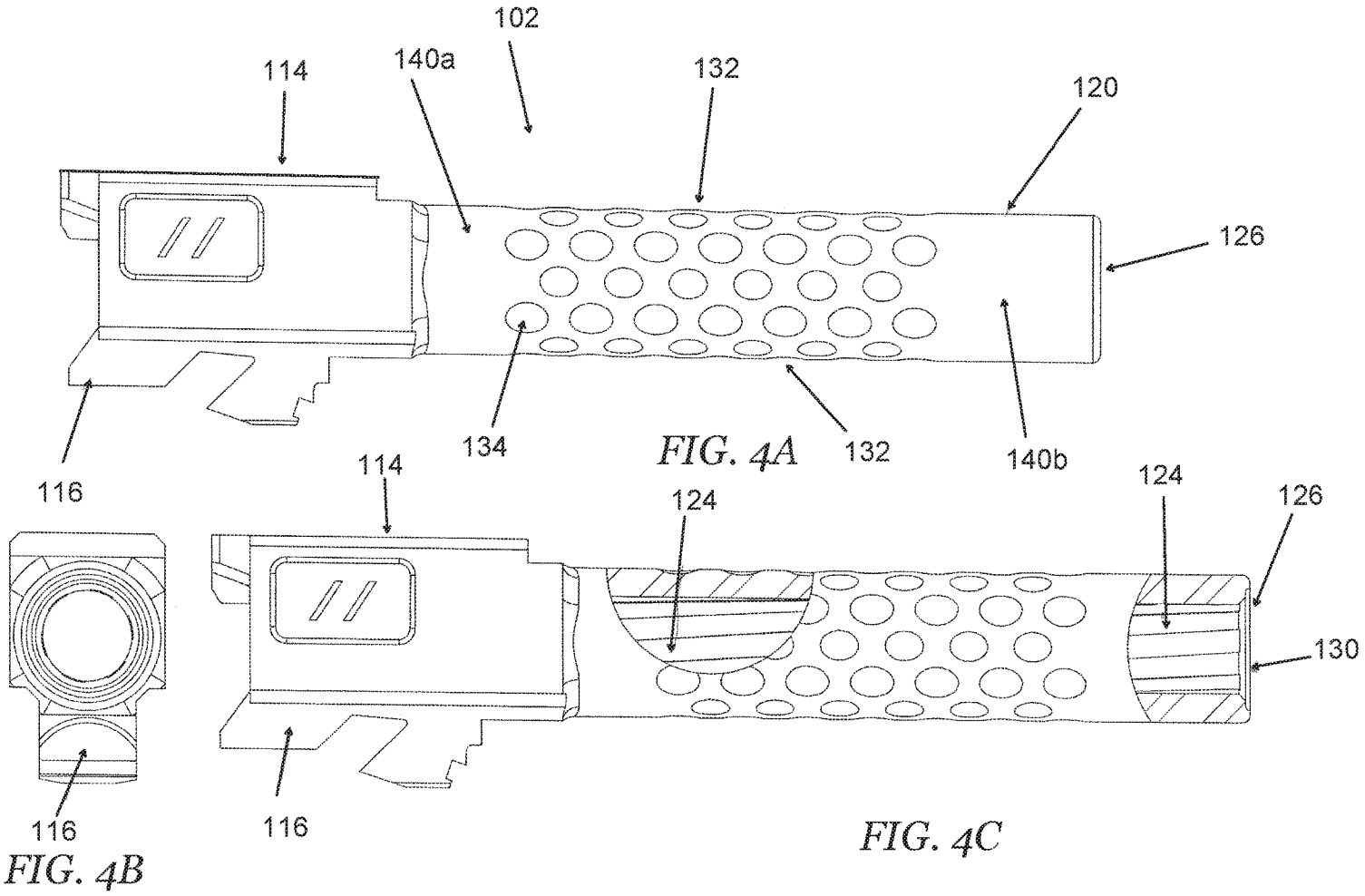
FIGS. 4A-D are side, front and partially exploded and annotated partially exploded side views of the barrel component of FIGS. 1-3.
Figure 4D:
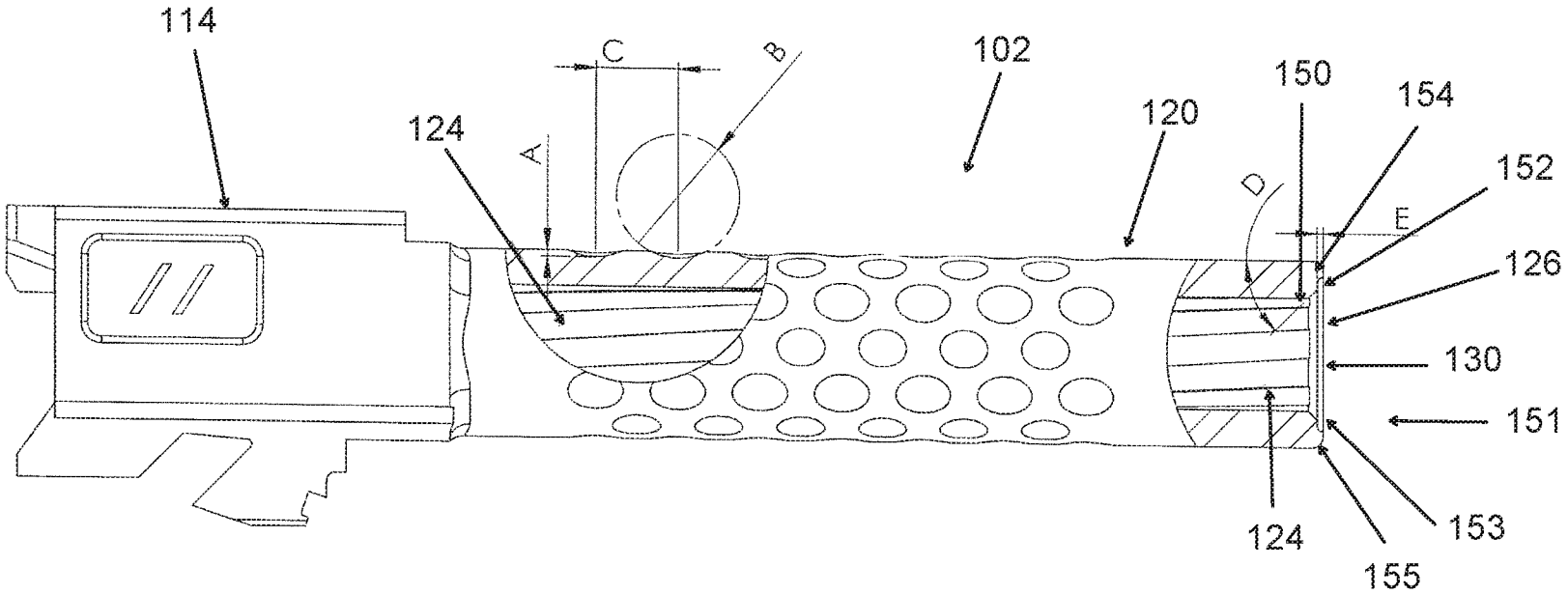

The flat portion 152 has a flat surface 153 that extends preferably perpendicularly away from the axis of the barrel path 122 and the straight portion 154 has a straight surface 155 that extends substantially parallel to the axis of the barrel path 122. Both the surfaces 153 and 155 extend substantially circumferentially around the barrel path 122. As shown in FIG. 5D, in one embodiment, the angled path is 0.027 inches in depth and the straight path is 0.018 inches in depth. The flat surface 153 begins at approximately 0.400 in diameter and the straight surface ends 0.471 inches in diameter, thus the flat surface has a diameter of approximately 0.071 inches. It will be appreciated though that these dimension are merely exemplary. Thus as shown in FIGS. 4D and 5D, the barrel crown features an initial crown of an angle of "D"; terminating at the end of the barrel. It is then protected with a circular pocket machined at a depth of "E" to protect the initial crown. In combination of both features, the accuracy of the barrel is improved.

The flat portion 152 and straight portion 154 basically define a recess that recesses the angled portion 150 from the outer end 126 of the barrel. By recessing the angled portion 150 from the end 126 of the barrel, the surfaces of the angled portion 150 are less likely to be damaged or scratched which reduces the likelihood of turbulence being introduced into the path of the gasses exiting the interior path 122 of the barrel. Moreover, the recess also reduces the potential of damage to the rifling as well.

Although the foregoing has shown, illustrated and described various embodiments, implementations, components and uses of the present invention, it will be apparent that various substitutions, modifications and changes to the form of the apparatus and the uses thereof may be made by those skilled in the art without departing from the spirit and scope of the present invention. Hence, the scope of the present invention should not be limited to the foregoing but should be defined by the appended claims.

What is claimed is:

1. A firearm barrel component for a semiautomatic pistol having a slide having an opening with inner walls, the firearm barrel component comprising:

a barrel member defining an interior path and an outer surface, the barrel member having a first end and a second end, wherein the interior path of the barrel member is rifled, and wherein the barrel member has an outer diameter that is sized to be adjacent the inner walls of the opening in the slide;

a firing chamber attached to the first end of the barrel member;

a pivoting assembly coupled to the firing chamber to permit the barrel component to pivot in a frame such that the second end of the barrel member will raise or lower with respect to the frame when the firearm is fired;

wherein the outer surface of the barrel member includes a plurality of indentations comprising dimples positioned over the rifled portion of the interior path of the barrel member that increase the surface area to dissipate heat;

wherein an outer portion of the barrel member is undimpled;

wherein the plurality of indentations comprise dimples that are uniformly spaced apart along the length and around the circumference of the barrel member so as to be separated by undimpled surface along the length, and wherein the dimples are separated along the length of the barrel member by a raised portion of the outer surface of the barrel member; and wherein the dimples are aligned in a plurality of longitudinal rows that extend along the length of the barrel member, such that dimples of the plurality of longitudinal rows do not overlap along the length of the barrel member with dimples of adjacent longitudinal rows.

2. The firearm barrel component of claim 1, wherein the barrel member has a length of approximately 4.00 inches to 5.00 inches.

3. The firearm barrel component of claim 1, wherein the barrel member has a crown portion that is positioned adjacent the second end of the barrel member.

4. The firearm barrel component of claim 3, wherein the crown portion is interposed between the rifled portion of the interior path of the barrel member and the second end of the barrel member.

5. The firearm barrel component of claim 4, wherein the crown portion includes an angled portion and a recessed portion, wherein the recessed portion defines a pocket that recesses the angled portion from the second end of the barrel member.

6. The firearm barrel component of claim 5, wherein the angled portion defines an angle of approximately 45 degrees and is approximately 0.027 inches in depth.

7. The firearm barrel component of claim 6, wherein the recessed portion is parallel to an axis defined by interior path of the barrel member and has a depth of 0.018 inches.

8. A semiautomatic pistol, comprising:

a frame;

a trigger assembly mounted on the frame;

a slide mounted on the frame, the slide having an opening with inner walls;

a barrel member defining an interior path and an outer surface, the barrel member having a first end and a second end and being positioned at least partially within the slide, wherein the interior path of the barrel member is rifled and wherein the barrel member has an outer diameter that is sized to be adjacent the inner walls of the opening in the slide;

a firing chamber attached to the first end of the barrel member;

a pivoting assembly coupled to the firing chamber to permit the barrel member to pivot with respect to the frame such that the second end of the barrel member will raise or lower with respect to the frame when the firearm is fired;

wherein the outer surface of the barrel member includes a plurality of indentations that comprise dimples that increase the surface area to dissipate heat and to reduce frictional engagement between the slide and the outer surface of the barrel member;

wherein an outer portion of the outer surface of the barrel member is smooth so as to engage the slide when the firearm is not being fired;

wherein the plurality of indentations comprise dimples that are uniformly spaced apart along the length and around the circumference of the barrel member so as to be separated by undimpled surface along the length, and wherein the dimples are separated along the length of the barrel member by a raised portion of the outer surface of the barrel member; and wherein the dimples are aligned in a plurality of longitudinal rows that extend along the length of the barrel member, such that dimples of the plurality of longitudinal rows do not overlap along the length of the barrel member with dimples of adjacent longitudinal rows.

9. The firearm barrel component of claim 1, wherein dimples of the plurality of longitudinal rows are offset in a longitudinal direction from dimples of adjacent longitudinal rows, such that dimples of the plurality of longitudinal rows partially overlap around the circumference of the barrel member with dimples of adjacent longitudinal rows.

10. The firearm barrel component of claim 1, wherein the plurality of indentations define a dimpled region of the barrel member, the dimpled region comprising a first end and a second end, and wherein, at every point along the length of the dimpled region from the first end of the dimpled region to the second end of the dimpled region, a plane oriented perpendicular to a longitudinal axis defined by the outer surface of the barrel member will pass through at least some dimples that partially overlap around the circumference of the barrel member with other dimples.

11. The firearm barrel component of claim 1, wherein the dimples have a depth of approximately 0.015 inches, with the center of the dimples in each longitudinal row being approximately 0.250 inches apart along the length of the barrel member.

12. The semiautomatic pistol of claim 8, wherein the barrel member has a length of approximately 4.00 inches.

13. The semiautomatic pistol of claim 12, wherein the barrel member has a crown portion that is positioned adjacent the second end of the barrel member.

14. The semiautomatic pistol of claim 13, wherein the crown portion is interposed between the rifled portion of the interior path of the barrel member and the second end of the barrel member.

15. The semiautomatic pistol of claim 14, wherein the crown portion includes an angled portion and a recessed portion, wherein the recessed portion defines a pocket that recesses the angled portion from the second end of the barrel member.

16. The semiautomatic pistol of claim 15, wherein the angled portion defines an angle of approximately 45 degrees and is approximately 0.027 inches in depth.

17. The semiautomatic pistol of claim 16, wherein the recessed portion is parallel to an axis defined by the interior path of the barrel member and has a depth of 0.018 inches.

18. The semiautomatic pistol of claim 8, wherein the dimples of the plurality of longitudinal rows are offset in a longitudinal direction from dimples of adjacent longitudinal rows, such that dimples of the plurality of longitudinal rows partially overlap around the circumference of the barrel member with dimples of adjacent longitudinal rows.

19. The semiautomatic pistol of claim 8, wherein the plurality of indentations define a dimpled region of the barrel member, the dimpled region comprising a first end and a second end, and wherein, at every point along the length of the dimpled region from the first end of the dimpled region to the second end of the dimpled region, a plane oriented perpendicular to a longitudinal axis defined by the outer surface of the barrel member will pass through at least some dimples that partially overlap around the circumference of the barrel member with other dimples.

20. The semiautomatic pistol of claim 8, wherein the dimples have a depth of approximately 0.015 inches, with the center of the dimples in each longitudinal row being approximately 0.250 inches apart along the length of the barrel member.

* * * * *